US010871154B2

(12) United States Patent
Ahn et al.

(10) Patent No.: US 10,871,154 B2
(45) Date of Patent: Dec. 22, 2020

(54) LINEAR COMPRESSOR HAVING SUCTION MUFFLER

(71) Applicant: LG Electronics Inc., Seoul (KR)

(72) Inventors: Kwangwoon Ahn, Seoul (KR); Kiwon Noh, Seoul (KR); Jongwoo Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 235 days.

(21) Appl. No.: 15/858,343

(22) Filed: Dec. 29, 2017

(65) Prior Publication Data

US 2018/0187666 A1 Jul. 5, 2018

(30) Foreign Application Priority Data

Dec. 30, 2016 (KR) ..... 10-2016-0184383

(51) Int. Cl.

*F04B 39/00* (2006.01)
*F04B 37/18* (2006.01)
*F04B 39/12* (2006.01)
*F04B 35/04* (2006.01)

(52) U.S. Cl.

CPC ..... *F04B 39/0061* (2013.01); *F04B 35/045* (2013.01); *F04B 37/18* (2013.01); *F04B 39/0027* (2013.01); *F04B 39/121* (2013.01); *F04B 39/0005* (2013.01); *Y10S 181/403* (2013.01)

(58) Field of Classification Search

CPC .... F04B 39/0061; F04B 37/18; F04B 39/121; F04B 39/0005; F04B 35/045; F04B 39/0027; Y10S 181/403

USPC ..... 417/312, 417

See application file for complete search history.

(56) References Cited

U.S. PATENT DOCUMENTS

2004/0247457 A1 12/2004 Kim et al.
2005/0142002 A1 6/2005 Kang et al.
2010/0260629 A1* 10/2010 Kang ..... F04B 35/045 417/417
2011/0014065 A1* 1/2011 Park ..... F04B 39/0061 417/312
2015/0004014 A1* 1/2015 Kim ..... F04B 39/0027 417/312

(Continued)

FOREIGN PATENT DOCUMENTS

EP 2977610 A1 1/2016

OTHER PUBLICATIONS

European Extended Search Report in European Application No. 17210085.1, dated Apr. 23, 2018, 5 pages.

*Primary Examiner* — Dominick L Plakkoottam
(74) *Attorney, Agent, or Firm* — Fish & Richardson P.C.

(57) ABSTRACT

A linear compressor includes a shell that includes a refrigerant suction part configured to suction refrigerant, a cylinder located in the shell, a piston configured to reciprocate within the cylinder in which the piston includes a piston body and a piston flange, and a suction muffler through which suctioned refrigerant passes in which the suction muffler includes a first muffler disposed in the piston body. The first muffler includes a first muffler body that defines a refrigerant passage and that extends in an axial direction, and a first muffler flange that extends from the first muffler body in a radial direction, that is configured to couple to the piston flange, and that defines a flange communication hole.

20 Claims, 10 Drawing Sheets

(56) References Cited

U.S. PATENT DOCUMENTS

| | | | | |
|---|---|---|---|---|
| 2015/0369237 | A1* | 12/2015 | Ahn | F04B 53/008<br>417/564 |
| 2015/0377531 | A1* | 12/2015 | Lee | F25B 43/003<br>62/473 |
| 2016/0017875 | A1* | 1/2016 | Noh | F04B 39/102<br>417/443 |
| 2016/0017883 | A1* | 1/2016 | Noh | F04B 35/045<br>417/437 |

* cited by examiner

LINEAR COMPRESSOR HAVING SUCTION MUFFLER

CROSS-REFERENCE TO RELATED APPLICATIONS

The present application claims priority under 35 U.S.C. 119 and 35 U.S.C. 365 to Korean Patent Application No. 10-2016-0184383, filed on Dec. 30, 2016, which is hereby incorporated by reference in its entirety.

FIELD

The present disclosure relates to a linear compressor.

BACKGROUND

A cooling system may circulate refrigerant to generate cool air. For example, a cooling system may perform processes of compressing, condensing, expanding, and evaporating of the refrigerant, and repeat those processes. In some examples, the cooling system may include a compressor, a condenser, an expansion device, and an evaporator. The cooling system may be installed in a home appliance such as a refrigerator or an air conditioner.

A compressor may receive power from a power generation device such as an electric motor or a turbine to compress air, refrigerant, or various working gases, thereby increasing a pressure thereof. The compressors have been widely used in home appliances or industrial fields.

The compressor may be classified into a reciprocating compressor, a rotary compressor, or a scroll compressor based on a compression chamber into/from which working gas is suctioned and discharged. For example, a compression chamber in a reciprocating compressor is defined between a piston and a cylinder to allow the piston to be linearly reciprocated into the cylinder, thereby compressing refrigerant. A compression chamber in a rotary compressor is defined between a roller that eccentrically rotates and a cylinder to allow the roller to eccentrically rotate along an inner wall of the cylinder, thereby compressing refrigerant. A compression chamber of a scroll compressor is defined between an orbiting scroll and a fixed scroll to compress refrigerant while the orbiting scroll rotates along the fixed scroll.

In recent years, a linear compressor, which is directly connected to a driving motor and includes a piston that linearly reciprocates, is being widely developed to improve compression efficiency without mechanical losses due to motion conversion. In some cases, the linear compressor may have a simple structure. For example, the linear compressor suctions and compresses refrigerant within a sealed shell while a piston linearly reciprocates within the cylinder by a linear motor and then discharges the compressed refrigerant.

In some examples, the linear motor is configured to allow a permanent magnet to be disposed between an inner stator and an outer stator. The permanent magnet can be driven to linearly reciprocate by electromagnetic force between the permanent magnet and the inner (or outer) stator. In some cases, since the permanent magnet operates in a state where the permanent magnet is connected to the piston, the permanent magnet may suction and compress refrigerant while linearly reciprocating within the cylinder and then discharge the compressed refrigerant.

In some examples, the linear compressor may be provided in a refrigerator in a machine room that is provided at a rear lower side of the refrigerator. In these cases, the linear compressor may include a shell for accommodating a plurality of components. A vertical height of the shell may be relatively high. In some examples, an oil supply assembly for supplying oil between a cylinder and a piston may be disposed within the shell.

In recent years, one interest of customers is an increase of an inner storage space of the refrigerator. To increase the inner storage space of the refrigerator, it may be necessary to reduce a volume of the machine room. In some cases, to reduce the volume of the machine room, reduction in size of the linear compressor has become a major issue.

In some examples, the linear compressor has a relatively large volume, and it is necessary to also increase the volume of the machine room in which the linear compressor is accommodated. In this case, the linear compressor may not be adequate for the refrigerator for increasing the inner storage space thereof.

To reduce the size of the linear compressor, it may be necessary to reduce a size of a main component of the compressor. In this case, the compressor may be deteriorated in performance.

To compensate the deteriorated performance of the compressor, it may be considered that the compressor increases a driving frequency. However, when the compressor increases a driving frequency, noises from opening and closing of a suction valve or a discharge valve provided in the compressor or noises from flow of refrigerant may increase.

SUMMARY

This disclosure may provide a linear compressor including a suction muffler that is capable of reducing noises.

This disclosure may provide a linear compressor in which a suction muffler improves the structure to maintain a pressure of suctioned refrigerant introduced into a suction port of a piston.

This disclosure may also provide a linear compressor in which a time point at which a suction valve is opened and a time point at which refrigerant increases in pressure match each other with respect to a piston that reciprocates at a high speed so that an amount of refrigerant suctioned into a compression chamber may increase when the suction valve is opened.

This disclosure may also provide a linear compressor in which refrigerant remaining in a piston is discharged to a rear side of a suction muffler while the piston moves from a top center to a bottom center to allow a relatively large amount of refrigerant suctioned into the piston to flow.

According to one aspect of the subject matter described in this application, a linear compressor includes a shell that includes a refrigerant suction part configured to suction refrigerant, a cylinder located in the shell, a piston configured to reciprocate within the cylinder in which the piston includes a piston body and a piston flange, and a suction muffler through which suctioned refrigerant passes in which the suction muffler includes a first muffler disposed in the piston body. The first muffler includes a first muffler body that defines a refrigerant passage and that extends in an axial direction, and a first muffler flange that extends from the first muffler body in a radial direction, that is configured to couple to the piston flange, and that defines a flange communication hole.

Implementations according to this aspect may include one or more of the following features. For example, the piston body and the first muffler body may be spaced apart from each other to define a discharge space configured to guide refrigerant from the piston to the flange communication hole. In some examples, the flange communication hole may include a plurality of flange communication holes. The first muffler body and the first muffler flange may be connected to each other at a rear portion of the first muffler body, and the plurality of flange communication holes are defined outside of the rear portion of the first muffler body.

In some implementations, the first muffler may further include a first flange extension part that extends rearward from a flange connection part of the first muffler flange in the axial direction. The flange communication hole may be defined between the flange connection part and an outer circumferential surface of the first muffler body, and the outer circumferential surface of the first muffler body may be configured to guide refrigerant discharged rearward through the flange communication hole to the first flange extension part. In some examples, the suction muffler may further include a second muffler disposed at a rear side of the first muffler; and a third muffler configured to accommodate the second muffler. The first flange extension part may include a first wall coupled to an inner circumferential surface of the third muffler. The second muffler may include a second wall coupled to an inner circumferential surface of the third muffler.

In some implantations, the piston body includes a main body front portion that defines a suction port, and the linear compressor may further include a suction valve provided at the suction port. The main body front portion may be spaced apart from the first muffler to define a suction space configured to guide refrigerant from the suction muffler to the suction port through the suction space. The suction space, the discharge space, and the flange communication hole communicate with each other. In some examples, each of the first and second mufflers may be coupled to the third muffler by press fitting.

In some implementations, the linear compressor may further include a muffler filter disposed at an interface at which the first muffler and the second muffler are coupled to each other. In some examples, the linear compressor may further include a suction guide part configured to guide refrigerant discharged from the first muffler to the suction port. The suction guide part includes a first extension part that extends from an outer circumferential surface of the first muffler body in the radial direction, and a second extension part that is bent from the first extension part and that extend towards the main body front portion of the piston.

According to another aspect of the subject matter, a linear compressor includes a shell that includes a refrigerant suction part configured to suction refrigerant, a cylinder located in the shell, a piston that is configured to reciprocate within the cylinder and that includes a piston body and a piston flange, and a suction muffler through which suctioned refrigerant passes. The suction muffler includes a first muffler that includes a first muffler body and a first muffler flange that defines a plurality of flange communication holes, a second muffler disposed at a rear side of the first muffler, and a third muffler configured to accommodate the second muffler.

Implementations according to this aspect may include one or more of the following features. For examples, the linear compressor may further include a muffler filter disposed at an interface at which the first muffler and the second muffler are coupled to each other. The piston body and the first muffler body may be spaced apart from each other to define a discharge space configured to guide refrigerant from the piston to the plurality of flange communication holes. The first muffler body may define a refrigerant passage and extends in an axial direction, and the first muffler flange may extend from the first muffler body in a radial direction and is coupled to the piston flange. In some examples, the first muffler may further include a first flange extension part that extends rearward from a flange connection part of the first muffler flange, and the plurality of flange communication holes may be defined between the flange connection part and an outer circumferential surface of the first muffler body.

The details of one or more implementations are set forth in the accompanying drawings and the description below. Other features will be apparent from the description and drawings, and from the claims.

DETAILED DESCRIPTION

Hereinafter, exemplary implementations will be described with reference to the accompanying drawings. The disclosure may, however, be implemented in many different forms and should not be construed as being limited to the implementations set forth herein; rather, that alternate implementations included in other retrogressive disclosures or falling within the spirit and scope of the present disclosure will fully convey the concept of the disclosure to those skilled in the art.

Figure 1:
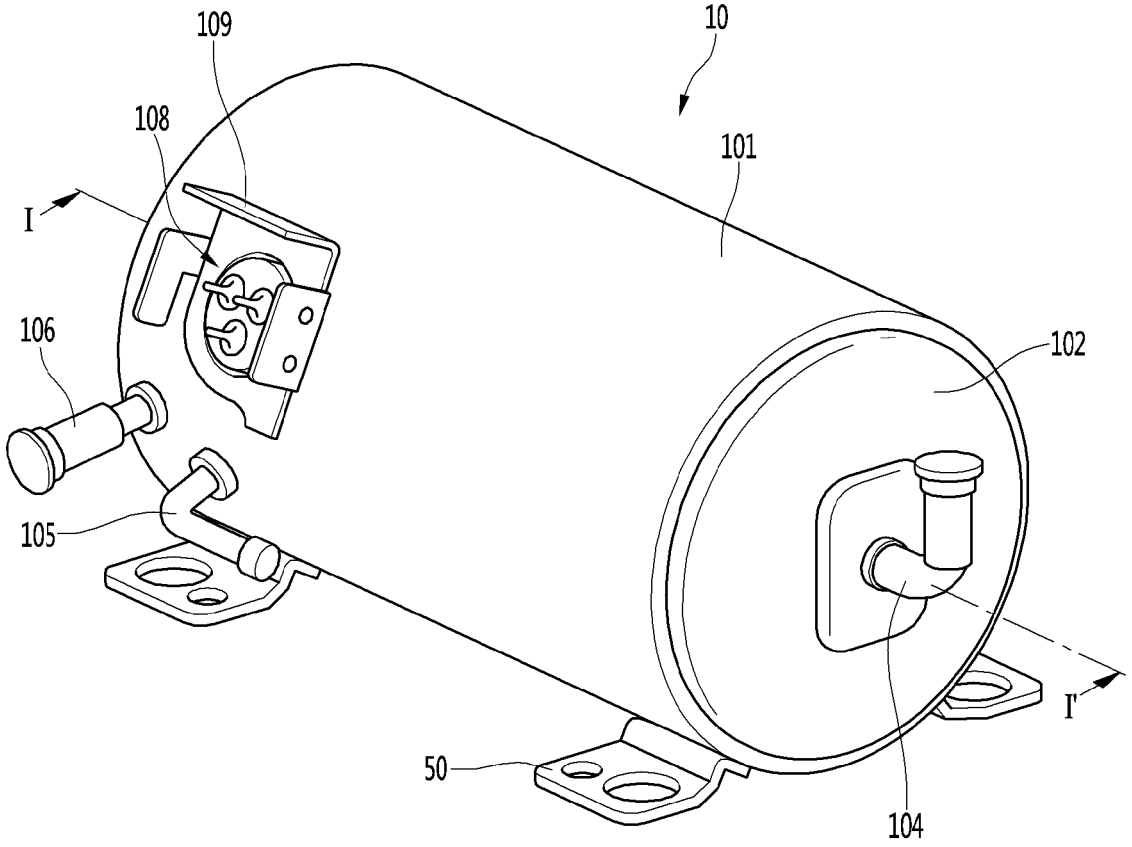
FIG. 1 is a perspective view illustrating an example outer appearance of an example linear compressor.
Figure 2:
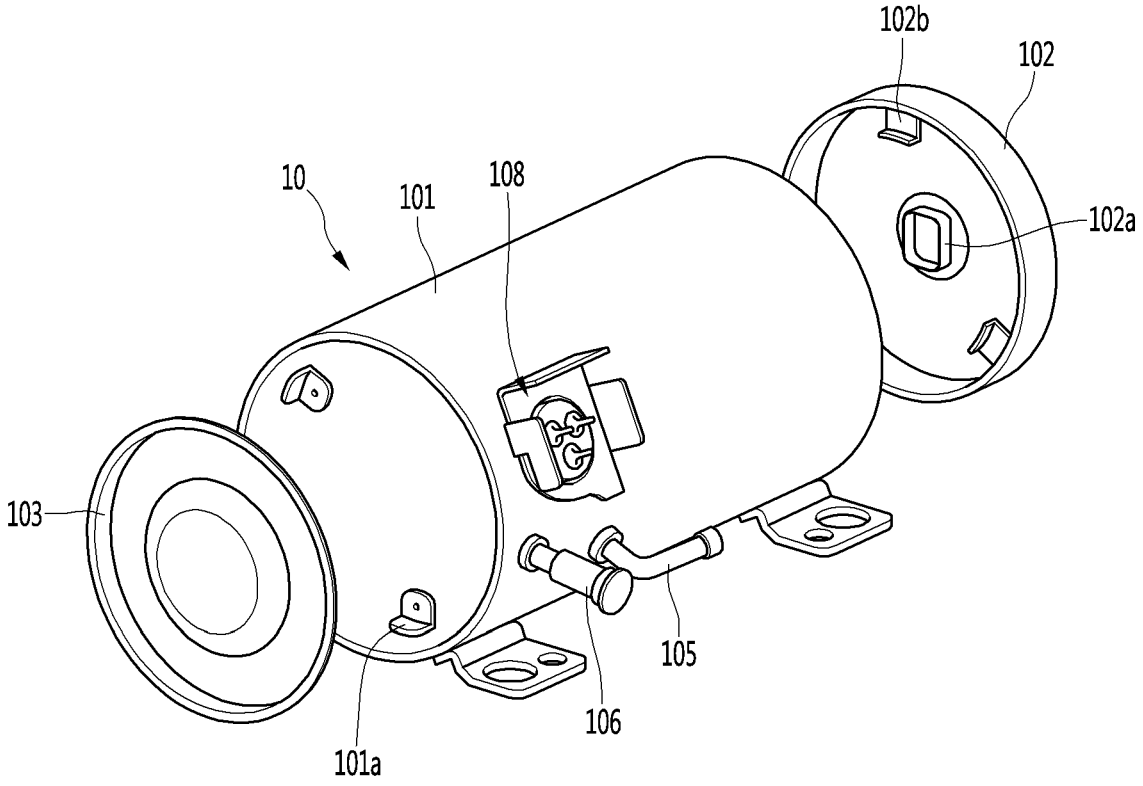
FIG. 2 is an exploded perspective view illustrating an example shell and an example shell cover of the linear compressor.

FIG. 1 is a perspective view illustrating an example outer appearance of an example linear compressor, and FIG. 2 is an exploded perspective view illustrating an example shell and an example shell cover of the linear compressor.

Referring to FIGS. 1 and 2, a linear compressor 10 includes a shell 101 and shell covers 102 and 103 coupled to the shell 101. In some examples, each of the first and second shell covers 102 and 103 may be one component of the shell 101.

A leg 50 may be coupled to a lower portion of the shell 101. The leg 50 may be coupled to a base of a product in which the linear compressor 10 is installed. For example, the product may include a refrigerator, and the base may include a machine room base of the refrigerator. As another example, the product may include an outdoor unit of an air conditioner, and the base may include a base of the outdoor unit.

The shell 101 may have an approximately cylindrical shape and be disposed to lie in a horizontal direction or an axial direction. In FIG. 1, the shell 101 may extend in the horizontal direction and have a relatively low height in a radial direction. That is, since the linear compressor 10 has a low height, when the linear compressor 10 is installed in the machine room base of the refrigerator, a machine room may be reduced in height.

A terminal 108 may be installed on an outer surface of the shell 101. The terminal 108 may be a component for transferring external power to a motor assembly (see reference numeral 140 of FIG. 3) of the linear compressor 10. The terminal 108 may be connected to a lead line of a coil (see reference numeral 141*c* of FIG. 3). A bracket 109 is installed outside the terminal 108. The bracket 109 may include a plurality of brackets surrounding the terminal 108. The bracket 109 may protect the terminal 108 against an external impact.

Both sides of the shell 101 may be opened. The shell covers 102 and 103 may be coupled to both the opened sides of the shell 101. In detail, the shell covers 102 and 103 includes a first shell cover 102 coupled to one opened side of the shell 101 and a second shell cover 103 coupled to the other opened side of the shell 101. An inner space of the shell 101 may be sealed by the shell covers 102 and 103.

In FIG. 1, the first shell cover 102 may be disposed at a right portion of the linear compressor 10, and the second shell cover 103 may be disposed at a left portion of the linear compressor 10. For example, the first and second shell covers 102 and 103 may be disposed to face each other.

The linear compressor 10 may further include a plurality of pipes 104, 105, and 106, which are provided in the shell 101 or the shell covers 102 and 103 to suction, discharge, or inject the refrigerant. The plurality of pipes 104, 105, and 106 include a suction pipe 104 through which the refrigerant is suctioned into the linear compressor 10, a discharge pipe 105 through which the compressed refrigerant is discharged from the linear compressor 10, and a process pipe through which the refrigerant is supplemented to the linear compressor 10.

For example, the suction pipe 104 may be coupled to the first shell cover 102. The refrigerant may be suctioned into the linear compressor 10 through the suction pipe 104 in an axial direction.

The discharge pipe 105 may be coupled to an outer circumferential surface of the shell 101. The refrigerant suctioned through the suction pipe 104 may flow in the axial direction and then be compressed. In some examples, the compressed refrigerant may be discharged through the discharge pipe 105. The discharge pipe 105 may be disposed at a position that is adjacent to the second shell cover 103 rather than the first shell cover 102.

The process pipe 106 may be coupled to an outer circumferential surface of the shell 101. A worker may inject the refrigerant into the linear compressor 10 through the process pipe 106. The process pipe 106 may be coupled to the shell 101 at a height different from that of the discharge pipe 105 to avoid interference with the discharge pipe 105. The height is understood as a distance from the leg 50 in the vertical direction (or the radial direction). Since the discharge pipe 105 and the process pipe 106 are coupled to the outer circumferential surface of the shell 101 at the heights different from each other, worker's work convenience may be improved.

At least a portion of the second shell cover 103 may be disposed adjacent to the inner circumferential surface of the shell 101, which corresponds to a point to which the process pipe 106 is coupled. For example, at least a portion of the second shell cover 103 may act as flow resistance of the refrigerant injected through the process pipe 106.

In some examples, in view of the passage of the refrigerant, the passage of the refrigerant introduced through the process pipe 106 may have a size that gradually decreases toward the inner space of the shell 101. In this process, a pressure of the refrigerant may be reduced to allow the refrigerant to be vaporized. In some examples, in this process, an oil component contained in the refrigerant may be separated. Thus, the refrigerant from which the oil component is separated may be introduced into the piston 130 to improve compression performance of the refrigerant. The oil component may be understood as working oil existing in a cooling system.

A cover support part 102*a* is disposed on an inner surface of the first shell cover 102. A second support device 185 that will be described later may be coupled to the cover support part 102*a*. The cover support part 102*a* and the second support device 185 may be configured to support a main body of the linear compressor 10. Here, the main body of the compressor represents a component provided in the shell 101. For example, the main body may include a driving part that reciprocates forward and backward and a support part supporting the driving part. The driving part may include components such as the piston 130, a magnet frame 138, a permanent magnet 146, a support 137, and a suction muffler 200. In some examples, the support part may include components such as resonant springs 176*a* and 176*b*, a rear cover 170, a stator cover 149, a first support device 165, and a second support device 185.

A stopper 102*b* may be disposed on the inner surface of the first shell cover 102. The stopper 102*b* may be configured to prevent the main body of the compressor, for example, the motor assembly 140 from being bumped by the shell 101 and thus damaged due to the vibration or the impact occurring during the transportation of the linear compressor 10. The stopper 102*b* may be disposed adjacent to the rear cover 170 that will be described later. Thus, when the linear compressor 10 is shaken, the rear cover 170 may interfere with the stopper 102*b* to prevent the impact from being transmitted to the motor assembly 140.

A spring coupling part 101*a* may be disposed on the inner circumferential surface of the shell 101. For example, the spring coupling part 101*a* may be disposed at a position that is adjacent to the second shell cover 103. The spring coupling part 101*a* may be coupled to a first support spring 166 of the first support device 165 that will be described later. Since the spring coupling part 101*a* and the first support device 165 are coupled to each other, the main body of the compressor may be stably supported inside the shell 101.

Figure 3:
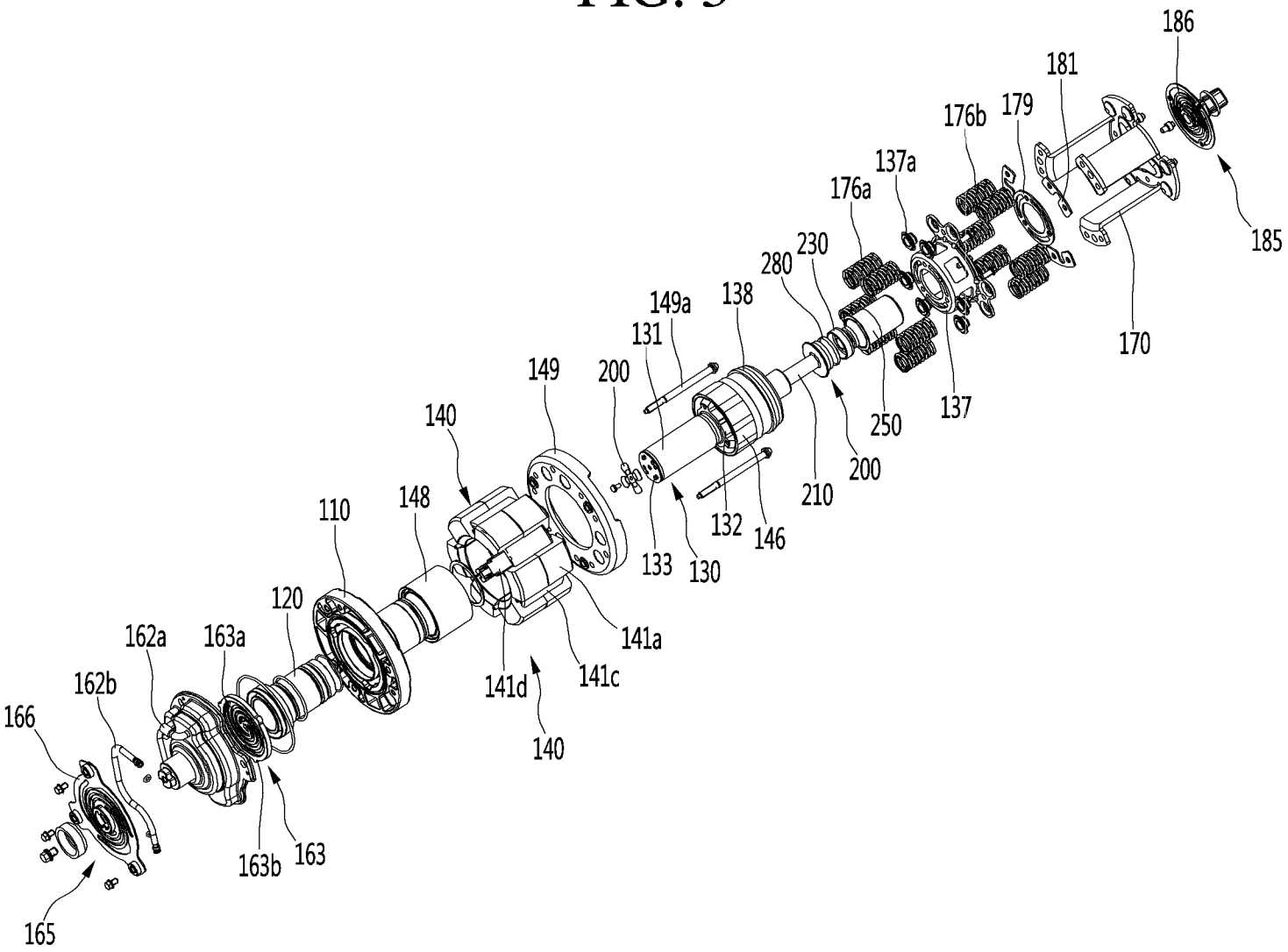
FIG. 3 is an exploded perspective view illustrating example internal components of the linear compressor.
Figure 4:
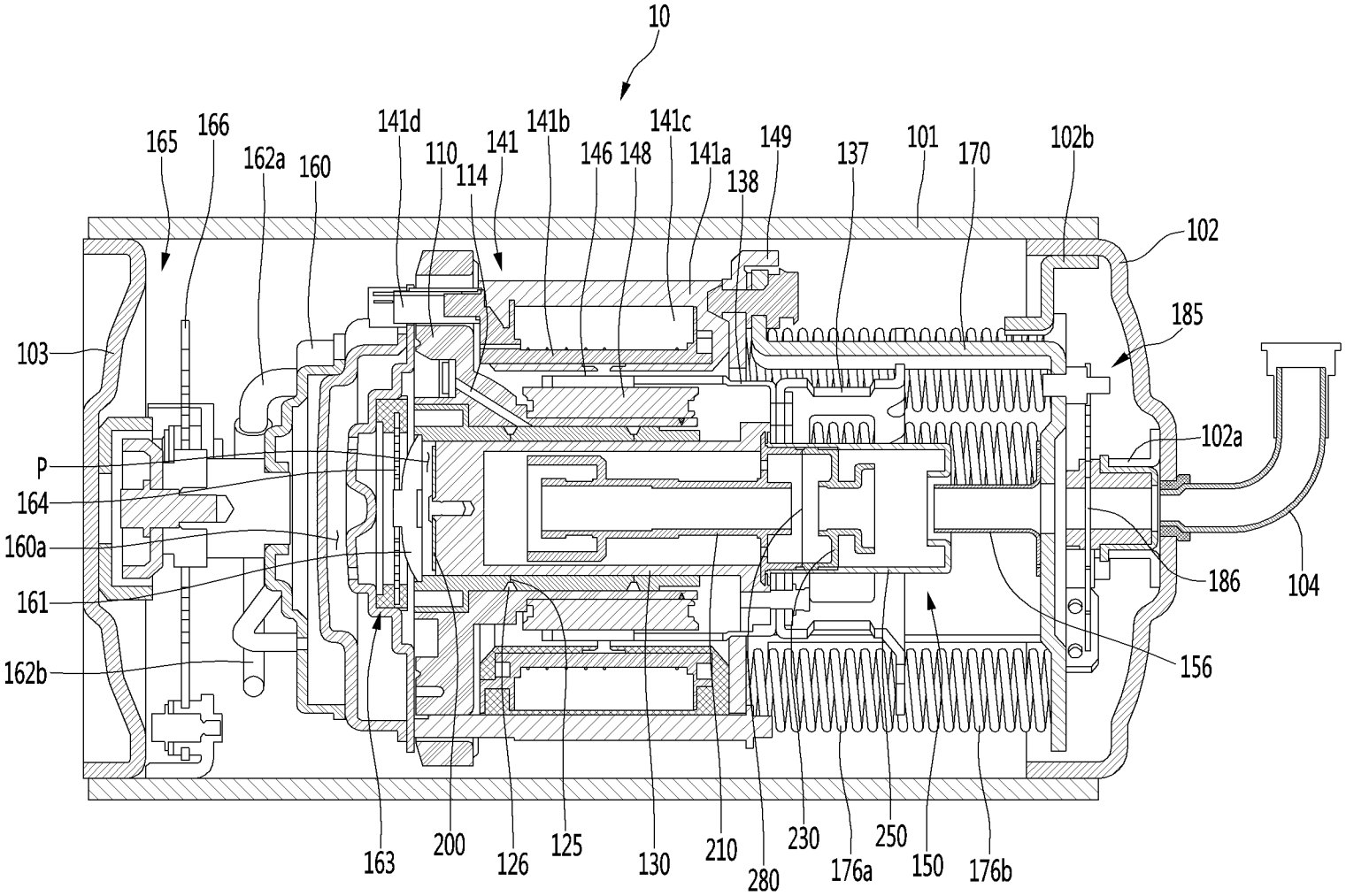
FIG. 4 is a cross-sectional view taken along line I-I' of FIG. 1.
Figure 5:
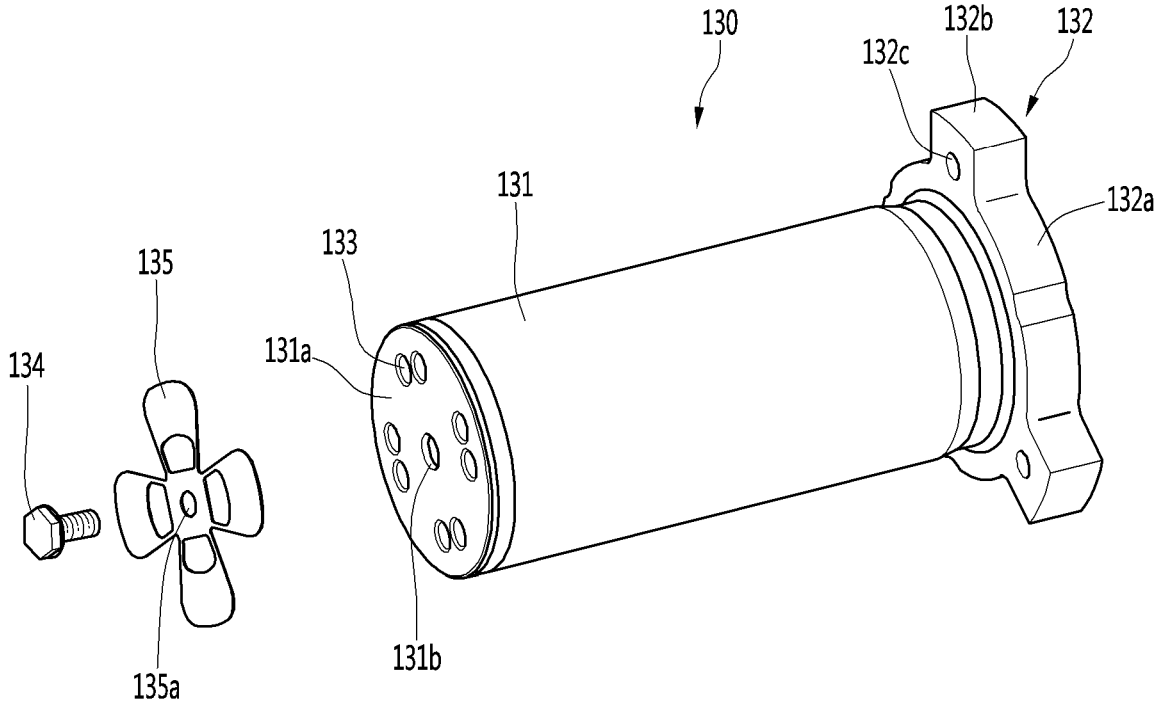
FIG. 5 is an exploded perspective view of an example piston assembly.

FIG. 3 is an exploded perspective view illustrating internal components of the linear compressor, FIG. 4 is a cross-sectional view illustrating the internal components of the linear compressor, and FIG. 5 is an exploded perspective view of a piston assembly.

Referring to FIGS. 3 to 5, the linear compressor 10 includes a cylinder 120 provided in the shell 101, a piston 130 that linearly reciprocates within the cylinder 120, and a motor assembly 140 that functions as a linear motor for applying driving force to the piston 130. When the motor assembly 140 is driven, the piston 130 may linearly reciprocate in the axial direction.

The linear compressor 10 further include a suction muffler 200 coupled to the piston 130 to reduce a noise generated from the refrigerant suctioned through the suction pipe 104.

The refrigerant suctioned through the suction pipe 104 flows into the piston 130 via the suction muffler 200. For example, while the refrigerant passes through the suction muffler 200, the flow noise of the refrigerant may be reduced.

The suction muffler 200 includes a plurality of mufflers 210, 230, and 250. The plurality of mufflers 210, 230, and 250 include a first muffler 210, a second muffler 230, and a third muffler 250, which are coupled to each other.

The first muffler 210 is disposed within the piston 130, and the second muffler 230 is coupled to a rear side of the first muffler 210. In some examples, the third muffler 250 accommodates the second muffler 230 therein and extends to a rear side of the first muffler 210. In view of a flow direction of the refrigerant, the refrigerant suctioned through the suction pipe 104 may successively pass through the third muffler 250, the second muffler 230, and the first muffler 210. In this process, the flow noise of the refrigerant may be reduced.

The suction muffler 200 further includes a muffler filter 280. The muffler filter 280 may be disposed on a boundary on which the first muffler 210 and the second muffler 230 are coupled to each other. For example, the muffler filter 280 may have a circular shape, and an outer circumferential portion of the muffler filter 280 may be supported between the first and second mufflers 210 and 230.

The direction will be defined. The "axial direction" may be a direction in which the piston 130 reciprocates (e.g., the horizontal direction in FIG. 4). In some examples, in the axial direction", a direction from the suction pipe 104 toward a compression chamber P, for example, a direction in which the refrigerant flows may be defined as a "front direction", and a direction opposite to the front direction may be defined as a "rear direction". When the piston 130 moves forward, the compression chamber P may be compressed. On the other hand, the "radial direction" may be a direction that is perpendicular to the direction in which the piston 130 reciprocates (e.g., the vertical direction in FIG. 4).

The piston 130 includes a piston body 131 having an approximately cylindrical shape and a piston flange part 132 extending from the piston body 131 in the radial direction. The piston body 131 may reciprocate inside the cylinder 120, and the piston flange part 132 may reciprocate outside the cylinder 120.

The cylinder 120 is configured to accommodate at least a portion of the first muffler 210 and at least a portion of the piston body 131. The cylinder 120 has the compression chamber P in which the refrigerant is compressed by the piston 130. In some examples, a suction port 133 through which the refrigerant is introduced into the compression chamber P is defined in a front surface of the piston body 131, and a suction valve 135 for selectively opening the suction port 133 is disposed on a front side of the suction port 133. A second coupling hole 135*a* to which a valve coupling member 134 is coupled is defined in an approximately central portion of the suction valve 135.

The valve coupling member 134 may be configured to couple the suction valve 135 to a first coupling hole 131*b* of the piston 130. The first coupling hole 131*b* may be defined in an approximately central portion of a front end surface of the piston 130. The valve coupling member 134 may pass through the second coupling hole 135*a* of the suction valve 135 and be coupled to the first coupling hole 131*b*.

The piston 130 includes a piston body 131 having an approximately cylindrical shape and extending in the front and rear direction and a piston flange part 132 extending outward from the piston body 131 in the radial direction.

The front portion of the piston body 131 includes a main body front surface 131*a* in which the first coupling hole 131*b* is defined. In some examples, the suction port 133 that is selectively covered by the suction valve 135 is disposed on the main body front surface 131*a*. The suction port 133 is provided in plurality, and the plurality of suction ports 133 are disposed outside the first coupling hole 131*b*. The plurality of suction ports 133 may be disposed to surround the first coupling hole 131*b*. For example, the plurality of suction ports 133 may include eight suction ports.

A rear portion of the piston body 131 may be opened to suction the refrigerant. At least a portion of the suction muffler 200 (e.g., the first muffler 210) may be inserted into the piston body 131 through the opened rear portion of the piston body 131.

The piston flange part 132 includes a flange body 132*a* extending outward from the rear portion of the piston body 131 in the radial direction and a piston coupling part 132*b* further extending outward from the flange body 132*a* in the radial direction.

The piston coupling part 132*b* includes a piston coupling hole 132*c* to which a predetermined coupling member is coupled. The coupling member may pass through the piston coupling hole 132*c* and be coupled to the magnet frame 138 and the support 137. In some examples, the piston coupling part 132*b* may be provided in plurality, and the plurality of piston coupling parts 132*b* may be spaced apart from each other and disposed on an outer circumferential surface of the flange body 132*a*.

A discharge cover 160, which defines a discharge space 160*a* for the refrigerant discharged from the compression chamber P, and discharge valve assemblies 161 and 163, which are coupled to the discharge cover 160 to selectively discharge the refrigerant compressed in the compression chamber P, may be provided at a front side of the compression chamber P. The discharge space 160*a* includes a plurality of space parts that are partitioned by inner walls of the discharge cover 160. The plurality of space parts are disposed in the front and rear direction to communicate with each other.

The discharge valve assemblies 161 and 163 include a discharge valve 161 that is configured to open when the pressure of the compression chamber P is above a discharge pressure to introduce the refrigerant into the discharge space 160*a* of the discharge cover 160 and a spring assembly 163 disposed between the discharge valve 161 and the discharge cover 160 to provide elastic force in the axial direction.

The spring assembly 163 includes a valve spring 163*a* and a spring support part 163*b* for supporting the valve spring 163*a* to the discharge cover 160. For example, the valve spring 163*a* may include a plate spring. In some examples, the spring support part 163*b* may be integrally injection-molded to the valve spring 163*a* through an injection-molding process.

The discharge valve 161 is coupled to the valve spring 163*a*, and a rear portion or a rear surface of the discharge valve 161 is disposed to be supported on the front surface of the cylinder 120. When the discharge valve 161 is supported on the front surface of the cylinder 120, the compression chamber P may be maintained in the sealed state. When the discharge valve 161 is spaced apart from the front surface of the cylinder 120, the compression chamber P may be opened to allow the refrigerant in the compression chamber P to be discharged.

The compression chamber P may be a space defined between the suction valve 135 and the discharge valve 161. In some examples, the suction valve 135 may be disposed on one side of the compression chamber P, and the discharge valve 161 may be disposed on the other side of the compression chamber P (e.g., an opposite side of the suction valve 135).

While the piston 130 is linearly reciprocated within the cylinder 120, when the pressure of the compression chamber P is below the discharge pressure and a suction pressure, the discharge valve 161 may be closed, and the suction valve 135 may be opened to suction the refrigerant into the compression chamber P. When the pressure of the compression chamber P is above the suction pressure, the suction valve 135 may compress the refrigerant of the compression chamber P in a state in which the suction valve 135 is closed.

When the pressure of the compression chamber P is above the discharge pressure, the valve spring 163*a* may be deformed forward to open the discharge valve 161. In this case, the refrigerant may be discharged from the compression chamber P into the discharge space 160*a* of the discharge cover 160. When the discharge of the refrigerant is completed, the valve spring 163*a* may provide restoring force to the discharge valve 161 to close the discharge valve 161.

The linear compressor 10 may further include a cover pipe 162*a* coupled to the discharge cover 160 to discharge the refrigerant flowing through the discharge space 160*a* of the discharge cover 160. For example, the cover pipe 162*a* may be made of a metal material.

In some implementations, the linear compressor 10 may further include a loop pipe 162*b* coupled to the cover pipe 162*a* to transfer the refrigerant flowing through the cover pipe 162*a* to the discharge pipe 105. The loop pipe 162*b* may have one side coupled to the cover pipe 162*a* and the other side coupled to the discharge pipe 105. The loop pipe 162*b* may be made of a flexible material and have a relatively long length. In some examples, the loop pipe 162*b* may roundly extend from the cover pipe 162*a* along the inner circumferential surface of the shell 101 and be coupled to the discharge pipe 105. For example, the loop pipe 162*b* may have a wound shape.

The linear compressor 10 may further include a frame 110. The frame 110 is configured to fix the cylinder 120. For example, the cylinder 120 may be press-fitted into the frame 110. Each of the cylinder 120 and the frame 110 may be made of aluminum or an aluminum alloy material. The frame 110 is disposed to surround the cylinder 120. That is, the cylinder 120 may be disposed to be accommodated into the frame 110. In some examples, the discharge cover 160 may be coupled to a front surface of the frame 110 by using a coupling member.

The motor assembly 140 includes an outer stator 141 fixed to the frame 110 and disposed to surround the cylinder 120, an inner stator 148 disposed to be spaced inward from the outer stator 141, and a permanent magnet 146 disposed in a space between the outer stator 141 and the inner stator 148.

The permanent magnet 146 may linearly reciprocate by mutual electromagnetic force between the outer stator 141 and the inner stator 148. In some examples, the permanent magnet 146 may be provided as a single magnet having one polarity or be provided by coupling a plurality of magnets having three polarities to each other.

The permanent magnet 146 may be disposed on the magnet frame 138. The magnet frame 138 may have an approximately cylindrical shape and be disposed to be inserted into the space between the outer stator 141 and the inner stator 148. In detail, in the cross-sectional view of FIG. 4, the magnet frame 138 may be coupled to the piston flange part 132 to extend in an outer radial direction and then be bent forward. The permanent magnet 146 may be installed on a front portion of the magnet frame 138. When the permanent magnet 146 reciprocates, the piston 130 may reciprocate together with the permanent magnet 146 in the axial direction.

The outer stator 141 includes coil winding bodies 141*b*, 141*c*, and 141*d* and a stator core 141*a*. The coil winding bodies 141*b*, 141*c*, and 141*d* include a bobbin 141*b* and a coil 141*c* wound in a circumferential direction of the bobbin 141*b*. The coil winding bodies 141*b*, 141*c*, and 141*d* further include a terminal part at the bobbin 141*d* that guides a power line connected to the coil 141*c* so that the power line is led out or exposed to the outside of the outer stator 141. The terminal part at the bobbin 141*d* may be disposed to be inserted into a terminal insertion part of the frame 110.

The stator core 141*a* may include a plurality of core blocks in which a plurality of laminations are laminated in a circumferential direction. The plurality of core blocks may be disposed to surround at least a portion of the coil winding bodies 141*b* and 141*c*.

A stator cover 149 may be disposed on one side of the outer stator 141. That is, the outer stator 141 may have one side supported by the frame 110 and the other side supported by the stator cover 149. The linear compressor 10 may further include a cover coupling member 149*a* for coupling the stator cover 149 to the frame 110. The cover coupling member 149*a* may pass through the stator cover 149 to extend forward to the frame 110 and then be coupled to a first coupling hole of the frame 110.

The inner stator 148 is fixed to an outer circumference of the frame 110. In some examples, in the inner stator 148, the plurality of laminations are laminated outside the frame 110 in the circumferential direction.

The linear compressor 10 may further include a support 137 for supporting the piston 130. The support 137 may be coupled to a rear portion of the piston 130, and the muffler 150 may be disposed to pass through the inside of the support 137. The piston flange part 132, the magnet frame 138, and the support 137 may be coupled to each other by using a coupling member. A balance weight 179 may be coupled to the support 137. A weight of the balance weight 179 may be determined based on a driving frequency range of the compressor body.

In some implementations, the linear compressor 10 may further include a rear cover 170 coupled to the stator cover 149 to extend backward and supported by the second support device 185. In detail, the rear cover 170 includes three support legs, and the three support legs may be coupled to a rear surface of the stator cover 149. A spacer 181 may be disposed between the three support legs and the rear surface of the stator cover 149. A distance from the stator cover 149 to a rear end of the rear cover 170 may be determined by adjusting a thickness of the spacer 181. In some examples, the rear cover 170 may be spring-supported by the support 137.

The linear compressor 10 may further include an inflow guide part 156 coupled to the rear cover 170 to guide an inflow of the refrigerant into the muffler 150. At least a portion of the inflow guide part 156 may be inserted into the suction muffler 200.

The linear compressor 10 may further include a plurality of resonant springs 176*a* and 176*b* that are adjusted in natural frequency to allow the piston 130 to perform a resonant motion. The plurality of resonant springs 176*a* and 176*b* include a first resonant spring 176*a* supported between the support 137 and the stator cover 149 and a second resonant spring 176*b* supported between the support 137 and the rear cover 170. The driving part that reciprocates within the linear compressor 10 may stably move by the action of the plurality of resonant springs 176*a* and 176*b* to reduce the vibration or noise due to the movement of the driving part. In some examples, the support 137 includes a first spring support part 137*a* coupled to the first resonant spring 176*a*.

The linear compressor 10 may further include a first support device 165 coupled to the discharge cover 160 to support one side of the main body of the compressor 10. The first support device 165 may be disposed adjacent to the second shell cover 103 to elastically support the main body of the compressor 10. In detail, the first support device 165 includes a first support spring 166. The first support spring 166 may be coupled to the spring coupling part 101*a*.

The linear compressor 10 may further include a second support device 185 coupled to the rear cover 170 to support the other side of the main body of the compressor 10. The second support device 185 may be coupled to the first shell cover 102 to elastically support the main body of the compressor 10. In detail, the second support device 185 includes a second support spring 186. The second support spring 186 may be coupled to the cover support part 102*a*.

Figure 6:
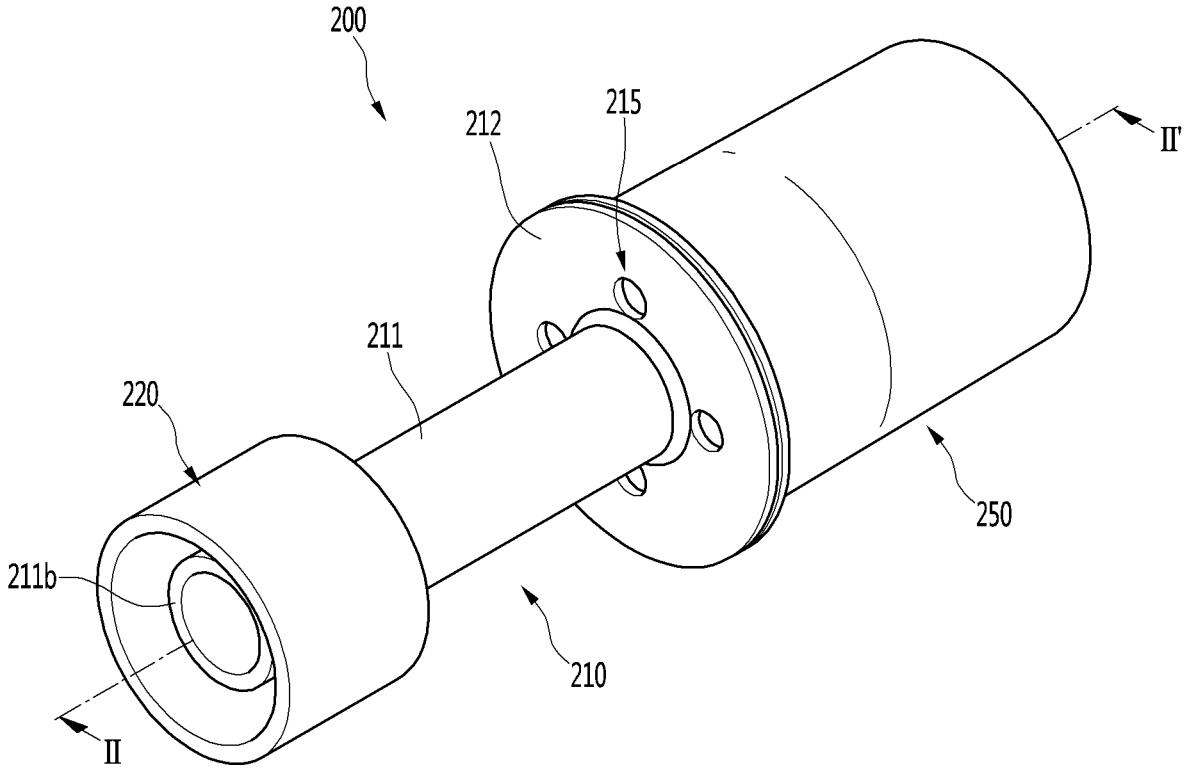
FIG. 6 is a perspective view illustrating an example configuration of an example suction muffler.
Figure 7:
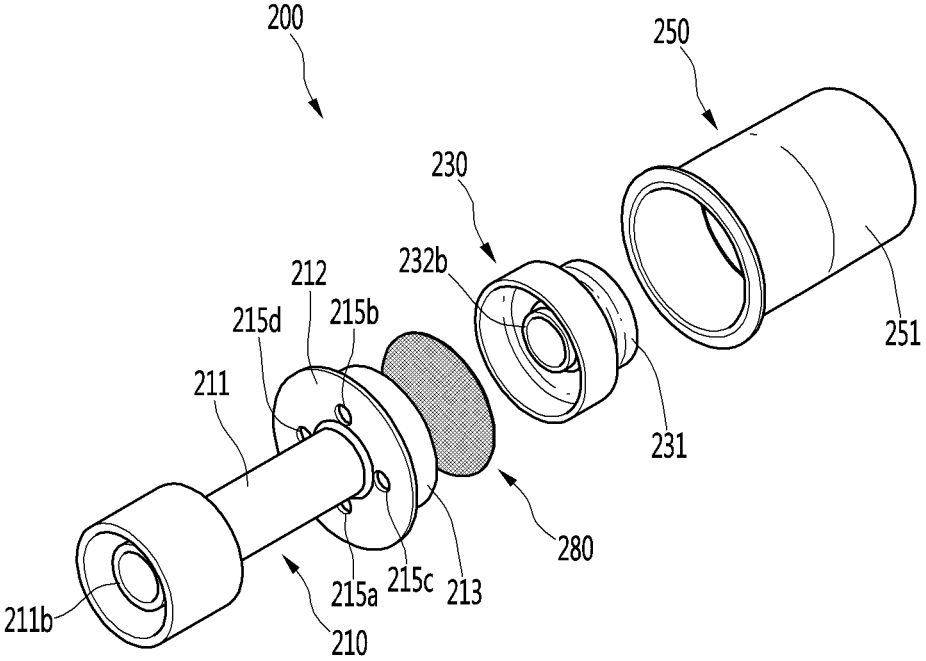
FIG. 7 is an exploded perspective view illustrating the configuration of the suction muffler.
Figure 8:
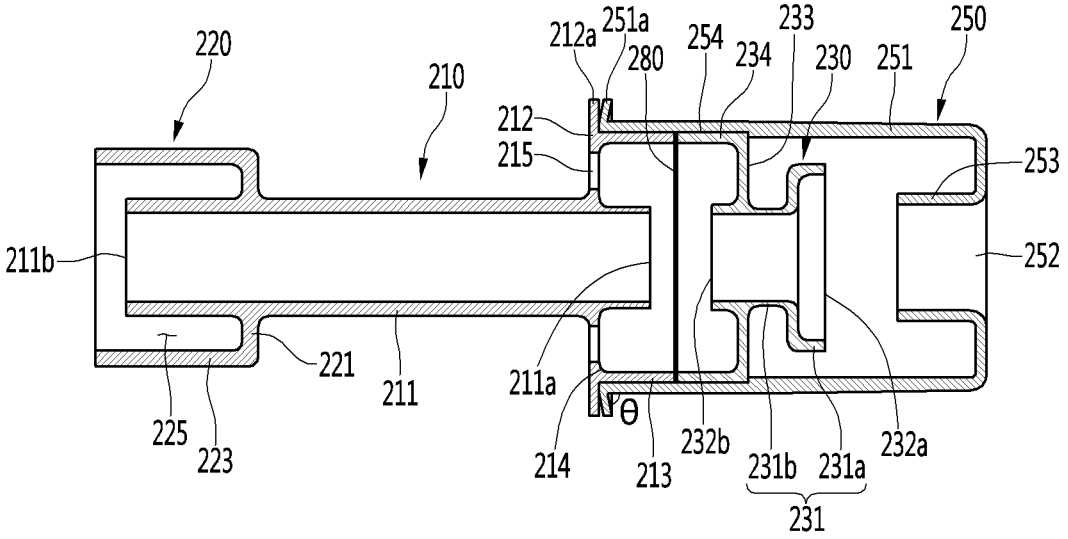
FIG. 8 is a cross-sectional view taken along line II-II' of FIG. 6.

FIG. 6 is a perspective view illustrating an example configuration of the suction muffler, FIG. 7 is an exploded perspective view illustrating the configuration of the suction muffler, and FIG. 8 is a cross-sectional view taken along line II-II' of FIG. 6.

Referring to FIGS. 6 to 8, the suction muffler 200 includes the plurality of mufflers 210, 230, and 250. The plurality of mufflers 210, 230, and 250 may be press-fitted to be coupled to each other. For example, the plurality of mufflers 210, 230, and 250 may be made of a plastic material and thus easily press-fitted to be coupled to each other. In some examples, while the refrigerant flows, a thermal loss through the plurality of mufflers 210, 230, and 250 may be reduced.

For example, the suction muffler 200 includes a first muffler 210, a second muffler 230 coupled to a rear side of the first muffler 210, and a muffler filter 280 supported by the first muffler 210 and the second muffler 230. In some examples, the suction muffler 200 further includes a third muffler 250 which is coupled to the first and second mufflers 210 and 230 and in which the inflow guide part 156 is inserted. The third muffler 250 extends to a rear side of the second muffler 230.

As another example, the third muffler 250 includes a third muffler body 251 having a cylindrical empty shape. The third muffler body 251 extends forward and backward. A through-hole 252 into which the inflow guide part 156 is inserted is defined in a rear surface of the third muffler 250. The through-hole 252 may be called an "inflow hole" for guiding the introduction of the refrigerant to the suction muffler 200.

The third muffler 250 may further include a protrusion 253 extending forward from the rear surface of the third muffler 250. The protrusion 253 may extend forward from an outer circumference of the through-hole 252, and the inflow guide part 156 may be inserted into the protrusion 253.

The first and second mufflers 210 and 230 may be coupled to the inside of the third muffler 250. For example, the first and second mufflers 210 and 230 may be press-fitted to be coupled to an inner circumferential surface of the third muffler 250. A stepped part 254 to which the second muffler 230 is coupled is disposed on the inner circumferential surface of the third muffler 250.

When the second muffler 230 moves to the inside of the third muffler 250 and then is press-fitted into the third muffler 250, the second muffler 230 may be hooked with the stepped part 254. The stepped part 254 may be a stopper for restricting the backward movement of the second muffler 230.

The first muffler 210 is coupled to a front end of the second muffler 230 and press-fitted into the inner circumferential surface of the third muffler 250. The muffler filter 280 may be inserted into a boundary to which the first and second mufflers 210 and 230 are coupled. In some examples, in the state in which the first and second mufflers 210 and 230 are press-fitted into the third muffler 250, the muffler filter 280 may be firmly fixed to the portion at which the first and second mufflers 210 and 230 are coupled to each other to prevent the muffler filter 280 from being separated from the suction muffler 200.

The second muffler 230 includes a second muffler body 231 configured to vary in cross-sectional area of a refrigerant passage, which is disposed from an upstream side to a downstream side with respect to the flow direction of the refrigerant. A second muffler inflow hole 232*a* through which the refrigerant discharged from the inflow guide part 156 is introduced is defined in a rear end of the second muffler body 231.

The second muffler body 231 includes a first part 231*a* extending to have a predetermined inner diameter forward from the second muffler inflow hole 232*a* and a second part 231*b* extending forward from the first part 231*a* and having an inner diameter less than that of the first part 231*a*. The second muffler inflow hole 232*a* is defined in a rear end of the first part 231*a*. According to the above-described constituents, the refrigerant introduced into the second muffler 230 through the second muffler inflow hole 232*a* passes through a passage having a reduced flow cross-sectional area while flowing from the first part 231*a* to the second part 231*b*.

A second muffler discharge hole 232*b* through which the refrigerant passing through the second part 231*b* is discharged is defined in the rear end of the second muffler body 231. The second muffler discharge hole 232*b* may be defined in a front end of the second part 231*b*.

The second muffler 230 includes a second muffler flange 233 extending from an outer circumferential surface of the front portion of the second muffler body 231 in a radial direction and a second flange extension part 234 extending forward from the second muffler flange 233. The second flange extension part 234 may be press-fitted into an inner circumferential surface of the third muffler 250. That is, the second flange extension part 234 may include a "second wall" press-fitted into the third muffler 250.

In some examples, a boundary between the second muffler flange 233 and the second flange extension part 234, for example, a portion that is bent from the radial direction to an axial direction may be a "hook protrusion" that is hooked with the stepped part 254 of the third muffler 250.

A cross-sectional area of a passage provided in the second flange extension part 234 may be greater than that of a passage of the second part 231*b*. Thus, the refrigerant discharged from the second muffler body 231 may be spread while flowing through the inside of the second flange extension part 234. Since a flow rate of the refrigerant is reduced by the spreading of the refrigerant, the noise may be reduced. For example, a noise having a high-frequency band ranging from about 4 KHz to about 5 KHz may be reduced.

The refrigerant discharged from the second muffler 230 may pass through the muffler filter 280 and then be introduced into the first muffler 210.

The first muffler 210 includes a first muffler body 211 disposed at a front side of the muffler filter 280, for example, a downstream side with respect to the flow direction of the refrigerant. The first muffler body 211 may have a cylindrical empty shape and extend forward. An inner space of the first muffler body 211 is defined as a refrigerant passage.

A first muffler inflow hole 211*a* through which the refrigerant passing through the muffler filter 280 is introduced is defined in a rear end of the first muffler body 211. In some examples, a first muffler discharge hole 211*b* through which the refrigerant passing through the first muffler body 211 is discharged is defined in a front end of the first muffler body 211.

The first muffler 210 further include a first muffler flange 212 extending from an outer circumferential surface of a rear portion of the first muffler body 211 in the radial direction. The first muffler flange 212 may be coupled to the piston flange part 132 of the piston 130. In some examples, a first piston coupling part 212*a* coupled to a coupling groove 132*d* of the piston 130 is disposed on an outer portion of the first muffler flange 212 in the radial direction. The coupling groove 132*d* may be defined in the piston flange part 132.

The third muffler 250 includes a second piston coupling part 251*a* coupled to the first piston coupling part 212*a*. The second piston coupling part 251*a* may extend outward from a front portion of the third muffler body 251 in the radial direction.

The first and second piston coupling parts 212*a* and 251*a* may be disposed between the support 137 and the piston flange part 132. In some examples, the second piston coupling part 251*a* may extend outward to be inclined in the radial direction with respect to the third muffler body 251. An angle θ between the third muffler body 251 and the second piston coupling part 251*a* may range from about 60 degrees to about 90 degrees. The second piston coupling part 251*a* may be elastically deformable.

Thus, the first and second piston coupling parts 212*a* and 251*a* may be stably supported between the support 137 and the piston flange part 132. In some examples, while moving to front and rear sides of the suction, the first and second piston coupling parts 212*a* and 251*a* may move in a state of being closely attached to each other or spaced apart from each other by inertial force. Thus, it may prevent an excessive load from acing on the suction muffler 200.

The first muffler 210 includes a first flange extension part 213 extending backward from the first muffler flange 212. The first flange extension part 213 may have an approximately cylindrical shape. The first flange extension part 213 may be press-fitted into the inner circumferential surface of the third muffler 250. For example, the first flange extension part 213 may include a "first wall" press-fitted into the third muffler 250. In some examples, the first muffler flange 212 includes a flange connection part 214 to which the first flange extension part 213 is connected.

In some examples, the first flange extension part 213 may support the front portion of the muffler filter 280. That is, the muffler filter 280 may be disposed between the first flange extension part 213 and the second flange extension part 234.

A passage of the first muffler body 211 has a cross-sectional area less than that of a discharge-side passage of the second muffler 230. That is, the refrigerant discharged from the second muffler 230 through the second muffler discharge hole 232*b* may decrease in cross-sectional area of the passage thereof and thus decrease in flow rate while being introduced into the first muffler body 211. Since the flow rate increases, the refrigerant may be improved in suction efficiency.

The first muffler 210 includes a suction guide part 220 that is disposed adjacent to the second discharge hole 359 to guide the refrigerant discharged from the first muffler discharge hole 211*b* to the suction port 133. The suction guide part 220 is configured to surround at least a portion of the first muffler body 211. In detail, the suction guide part 220 includes a first extension part 221 extending outward from one point on the outer circumferential surface of the first muffler body 211 and a second extension part 223 bent from the first extension part 221 to extend backward.

A space that is opened backward and defined by the first extension part 221, the second extension part 223, and the first muffler body 211 may be a storage space 225 in which at least a portion of the refrigerant suctioned into the compression chamber P is stored.

At least a portion of the refrigerant discharged from the first muffler discharge hole 221*b* may flow backward through a space between the piston 130 and the first muffler body 211 or generate eddy current in a surrounding space of the first muffler discharge hole 211*b*. For example, the more an amount of refrigerant suctioned into the compression chamber P increases, the more a flow amount of refrigerant increases. Thus, the back flow or the eddy current may deteriorate suction efficiency of the refrigerant.

The storage space 225 may store the flowing refrigerant to prevent the refrigerant from flowing backward or prevent the eddy current from occurring in the refrigerant. In some examples, the refrigerant stored in the storage space 225 may be suctioned into the compression chamber P during the next suction process after the refrigerant is suctioned, compressed, and discharged. As described above, the suction guide part 220 may be provided at the position adjacent to the first muffler discharge hole 211*b* to control the flow of the refrigerant, thereby improving the suction efficiency of the refrigerant.

A flange communication hole 215 is defined in the first muffler flange 212. The flange communication hole 215 may be configured to guide the refrigerant so that a pressure of the refrigerant in a suction space part (see reference numeral 290 of FIG. 9) quickly increases when the refrigerant is suctioned.

For example, when the refrigerant compressed in the compression chamber P is discharged to the discharge cover 160, the piston 130 may move from the top dead center to the bottom dead center. In this process, the refrigerant suctioned into the compressor 10 flows into the piston 130 through the suction muffler 200. Here, when the refrigerant in the suction space part 260 has a high pressure and maintained at the high pressure for a long time, the suction valve 135 may be more quickly opened. In some examples, the opened state of the suction valve 135 may be maintained for a long time. In this case, a large amount of refrigerant may be introduced into the compression chamber P.

However, when the pressure of the refrigerant in the suction space part 260 is relatively low at a time point at which the suction valve 135 is opened, a small amount of refrigerant may be introduced into the compression chamber P through the opened suction valve 135. Thus, it may be necessary to quickly increase the pressure of the refrigerant in the suction space part 260 at the time point at which the suction valve 135 is opened.

When the piston 130 moves backward, for example, to the bottom dead center after the refrigerant is discharged from the compression chamber P, the refrigerant may not be quickly introduced into the first muffler 210 by a volume of the refrigerant remaining between the piston 130 and the first muffler 210. Thus, the flange communication hole 215 may be configured to guide the refrigerant so that the remaining refrigerant flows backward and is discharged from the piston 130.

At least a portion of the first muffler flange 212 may pass through the flange communication hole 215. The flange communication hole 215 may be provided in plurality. For example, the plurality of flange communication holes 215 may be defined in upper and lower sides and left and right sides when the first muffler 210 is viewed from a front side. In detail, the plurality of flange communication holes 215 may be defined in a portion at which the first muffler body 211 and the first muffler flange 212 are connected to each other, for example, outside the rear end of the first muffler body 211.

The plurality of flange communication holes 215 are defined to be spaced a set distance from each other outside the rear end of the first muffler body 211. For example, the plurality of flange communication holes 215 includes a first communication hole 215*a*, a second communication hole 215*b*, a third communication hole 215*c*, and a fourth communication hole 215*d*.

When the flange communication hole 215 is defined lean to a specific position of the first muffler flange 212, it may be difficult to discharge the refrigerant. In addition, the refrigerant may be suctioned through the suction port 133 that is relatively close to the flange communication hole 215. Thus, in this implementation, the plurality of flange communication holes 215 may be uniformly distributed in the vertical and horizontal directions with respect to the first muffler body 211 so that the remaining refrigerant is easily discharged backward. However, the present disclosure is not limited to the number of flange communication holes 215.

The flange communication hole 215 may be defined between the flange connection part 214 and the outer circumferential surface of the first muffler body 211. Thus, the refrigerant discharged backward through the flange communication hole 215 may flow into the first flange extension part 213 and then be introduced together with the refrigerant, which is suctioned into the suction muffler 200, into the first muffler body 211 through the first muffler inflow hole 211*a*.

Figure 9:
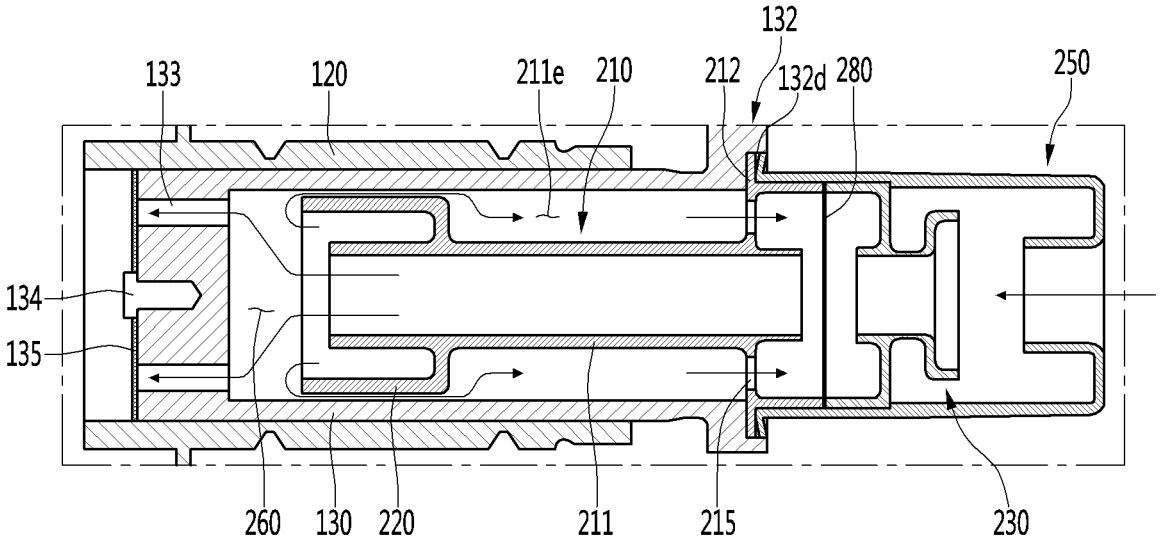
FIG. 9 is a cross-sectional view illustrating an example flow of refrigerant suctioned into an example suction port of the piston through the suction muffler.
Figure 10:
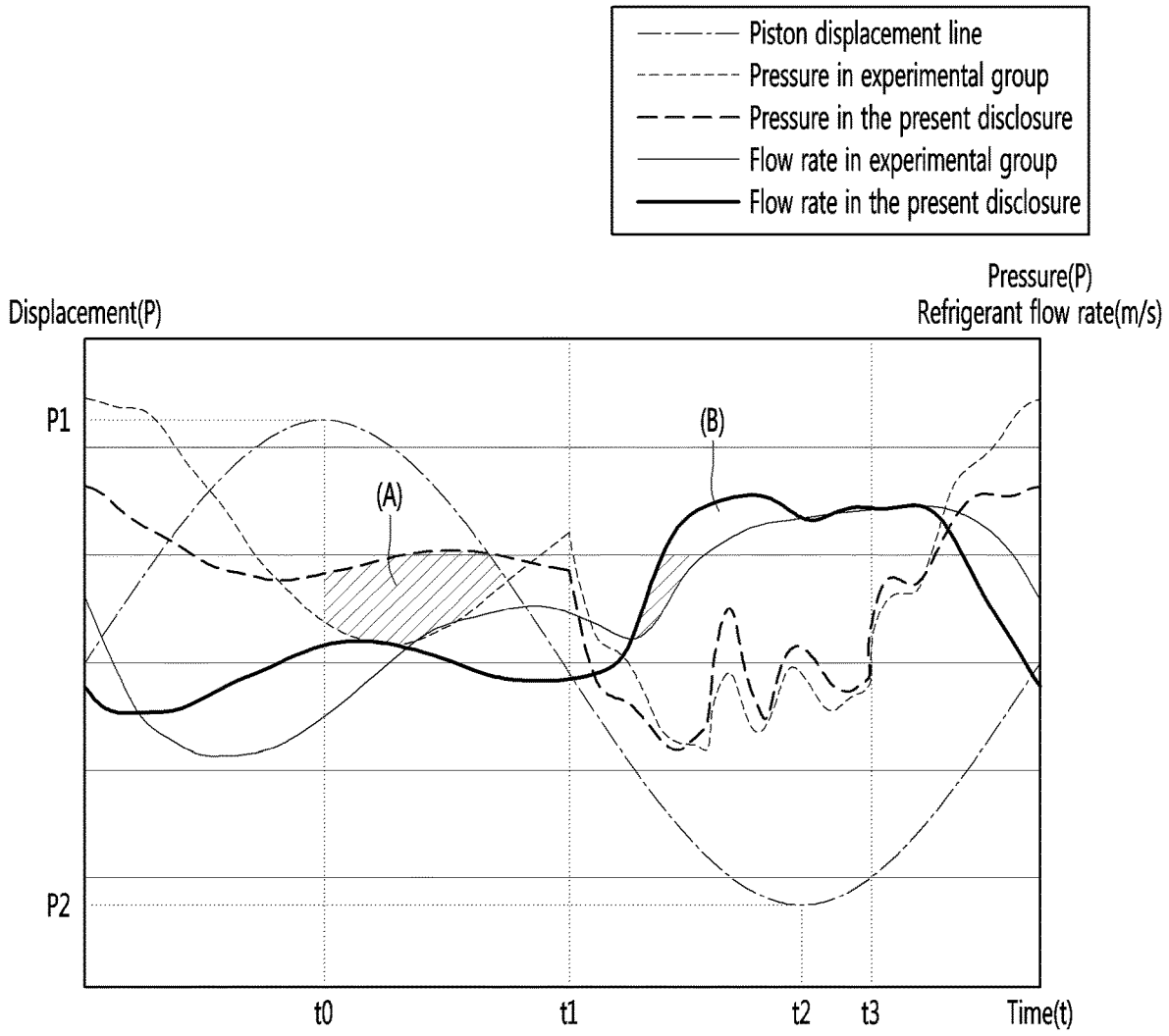
FIG. 10 is an experimental graph illustrating an increase of a suction flow rate of the linear compressor including the suction muffler.

FIG. 9 is a cross-sectional view illustrating a flow of refrigerant suctioned into the suction port of the piston through the suction muffler, and FIG. 10 is an experimental graph illustrating that a suction flow rate increases compared to the related art in case of the linear compressor to which the suction muffler is adopted.

A flow of refrigerant according to this implementation will be described with reference to FIG. 9. The refrigerant suctioned into the compressor 10 flows into the suction muffler 200 through the through-hole 252. The refrigerant may be introduced into the first muffler body 211 through the first muffler inflow hole 211*a* via the second muffler 230.

The refrigerant within the first muffler body 211 flows into the suction space part 260 and may be suctioned into the compression chamber P through the suction port 133 of the piston 130 when the suction valve 135 is opened. Here, the suction space part 260 may be a space between a main body front surface 131*a* of the piston 130 and the front end of the suction muffler 200 (e.g., the front end of the first muffler 210).

When the compression chamber P has a pressure greater than that of the suction space part 260, the suction valve 135 may be closed, and the piston 130 may move forward. Thus, the compression chamber P may be reduced in volume to compress the refrigerant. When the compression chamber P increases in pressure so that the compression chamber P has a pressure greater than that of the discharge space 160*a*, the discharge valve 161 is opened to discharge the refrigerant. Here, the piston 130 is disposed at the top dead center (see reference symbol P1 of FIG. 10) at a time to.

When the refrigerant is discharged, the piston 130 and the suction muffler 200 move backward. Then, as described above, the refrigerant is suctioned into the suction muffler 200. Here, the refrigerant remaining in the piston 130, for example, in the space between the piston 130 and the first muffler 210 or in the suction space part 260 may be discharged backward through the flange communication hole 215, and thus, the refrigerant may be quickly suctioned into the suction muffler 200. As a result, a phenomenon in which the refrigerant decreases in pressure may be reduced.

A discharge space part 211*e* having a passage through which the remaining refrigerant is discharged is defined between the inner circumferential surface of the piston body 131 and the outer circumferential surface of the first muffler body 211. The refrigerant may flow backward from the suction space part 260 through the discharge space part 211*e* and then be discharged from the first muffler 210 through the flange communication hole 215. That is, the suction space part 260, the discharge space part 211*e*, and the flange communication hole 215 may communicate with each other.

In some examples, the first muffler flange 212 may be a configuration in which the first muffler flange 212 is disposed at a rear side of the discharge space part 211*e*. As described above, while the piston 130 moves from the top dead center to the bottom dead center, the discharge and suction of the refrigerant may be performed together within the piston 130 to cause circulation of the refrigerant.

FIG. 10 illustrates a pressure distribution measured in the suction space part 260 in a case (thick dotted line) of the suction muffler 200 according to this implementation and a case (thin dotted line) of an experimental group in which the flange communication hole 215 is not defined in the structure of the suction muffler 200.

When the piston 130 moves from the top dead center P1 to the bottom dead center P2 (a time t3), the pressure of the suction space part 260 decreases and then increases again in case of the experimental group. On the other hand, it is seen that the pressure of the suction space part 260 at the top dead center P1 is almost maintained. That is, as illustrated in FIG. 10, it is seen that the pressure of the suction space part 260 is maintained at a high level by an area A in case of the present disclosure when compared to the experimental group.

In some examples, since the suction space part 260 is maintained at a relatively high pressure, when the suction valve 135 is opened, an amount of refrigerant suctioned into the compression chamber P may increase. For example, as illustrated in FIG. 10, it is seen that an amount of refrigerant suctioned into the compression chamber P increases by the area A in the case (thick solid line) of the suction muffler 200 according to this implementation when compared to the case (thin solid line) of the experimental group in which the flange communication hole 215 is not defined in the structure of the suction muffler 200 according to this implementation. In FIG. 10, a time period from a time t1 to a time t2 represents an opening period of the suction valve 135.

As described above, since the flange communication hole 215 is defined in the first muffler to guide the discharge of the refrigerant remaining in the piston 130, the refrigerant may be quickly suctioned through the suction muffler 200, and the suction space part 260 may be maintained at a relatively high pressure. Therefore, since the refrigerant has a high pressure in the time period at which the suction valve 135 is opened, an amount of refrigerant suctioned into the compression chamber P may increase. As a result, the compressor 10 may be improved in suction efficiency.

According to the implementations, the three mufflers may be coupled to each other to constitute the suction muffler, thereby reducing the noises having the various frequency bands such as the high-frequency noises and the low-frequency noises.

In some examples, the communication hole may be defined in the flange of the first muffler to discharge the refrigerant remaining in the piston to the outside of the piston when the piston moves from the top dead center to the bottom dead center. As a result, the refrigerant may be maintained at the high pressure from the beginning of the piston moving from the top dead center to the bottom dead center.

Therefore, when the suction valve is opened to suction the refrigerant, the amount of refrigerant suctioned into the suction port through the piston may increase. That is, the time point at which the suction valve is opened and the time point at which the suctioned refrigerant increases in pressure may match each other to improve the suction performance of the compressor.

In some examples, the three mufflers may be press-fitted and coupled to each other to constitute the suction muffler, thereby easily manufacturing the mufflers and reducing the number of manufacturing processes. For example, since the first muffler is press-fitted after the second muffler is press-fitted into the third muffler, the inward force may act on the third muffler, and the outward force may act on the first and second mufflers to maintain the valance of the force, thereby effectively assemble the suction muffler.

In some examples, the muffler may be made of the plastic material to reduce the thermal loss through the muffler while the refrigerant flows.

Although implementations have been described with reference to a number of illustrative implementations thereof, it should be understood that numerous other modifications and implementations can be devised by those skilled in the art that will fall within the spirit and scope of the principles of this disclosure. Various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A linear compressor comprising:

a shell comprising a refrigerant suction part configured to suction refrigerant;

a cylinder located in the shell;

a piston configured to reciprocate within the cylinder, the piston comprising a piston body that defines a first inner space therein and a piston flange; and a suction muffler through which suctioned refrigerant passes, the suction muffler comprising:

a first muffler disposed in the first inner space of the piston body, and a second muffler that contacts the first muffler, the second muffler protruding toward an outside of the piston body and defining a second inner space therein, wherein the first muffler comprises:

a first muffler body that defines a refrigerant passage and that extends in an axial direction, and a first muffler flange that extends from the first muffler body in a radial direction, that is coupled to the piston flange, and that defines a flange communication hole configured to provide the refrigerant in the first inner space in the piston body to the second inner space in the second muffler, and wherein the first muffler flange partitions the first inner space in the piston body from the second inner space in the second muffler.

2. The linear compressor according to claim 1, wherein the piston body and the first muffler body are spaced apart from each other to define a discharge space configured to guide refrigerant from the piston to the flange communication hole, and wherein the first inner space comprises the discharge space.

3. The linear compressor according to claim 1, wherein the flange communication hole includes a plurality of flange communication holes.

4. The linear compressor according to claim 3, wherein the first muffler body and the first muffler flange are connected to each other at a rear portion of the first muffler body, and wherein the plurality of flange communication holes are defined radially outside of the rear portion of the first muffler body.

5. The linear compressor according to claim 1, wherein the first muffler further comprises a first flange extension part that extends rearward from a flange connection part of the first muffler flange in the axial direction.

6. The linear compressor according to claim 5, wherein the flange communication hole is defined between the flange connection part and an outer circumferential surface of the first muffler body, and wherein the outer circumferential surface of the first muffler body is configured to guide refrigerant discharged rearward through the flange communication hole to the first flange extension part.

7. The linear compressor according to claim 5, wherein the suction muffler further comprises:

a third muffler that accommodates the second muffler.

8. The linear compressor according to claim 7, wherein the first flange extension part comprises a first wall coupled to an inner circumferential surface of the third muffler.

9. The linear compressor according to claim 7, wherein the second muffler comprises a second wall coupled to an inner circumferential surface of the third muffler.

10. The linear compressor according to claim 2, wherein the piston body includes a main body front portion that defines a suction port, and wherein the linear compressor further comprises a suction valve provided at the suction port.

11. The linear compressor according to claim 10, wherein the main body front portion is spaced apart from the first muffler to define a suction space configured to guide refrigerant from the suction muffler to the suction port through the suction space.

12. The linear compressor according to claim 11, wherein the suction space, the discharge space, and the flange communication hole communicate with one another in the axial direction.

13. The linear compressor according to claim 7, wherein each of the first and second mufflers is coupled to the third muffler by press fitting.

14. The linear compressor according to claim 7, further comprising a muffler filter disposed at an interface at which the first muffler and the second muffler are coupled to each other.

15. The linear compressor according to claim 10, further comprising a suction guide part configured to guide refrigerant discharged from the first muffler to the suction port, wherein the suction guide part comprises:

a first extension part that extends from an outer circumferential surface of the first muffler body in the radial direction, and a second extension part that is bent from the first extension part and that extends towards the main body front portion of the piston.

16. A linear compressor comprising:

a shell comprising a refrigerant suction part configured to suction refrigerant;

a cylinder located in the shell;

a piston configured to reciprocate within the cylinder, the piston comprising a piston body and a piston flange; and a suction muffler through which suctioned refrigerant passes, wherein the suction muffler comprises:

a first muffler comprising a first muffler body and a first muffler flange;

a second muffler that contacts the first muffler, the second muffler protruding toward an outside of the piston body; and a third muffler configured to accommodate the second muffler, wherein the first muffler flange partitions a first inner space in the piston body from a second inner space in the second muffler, and wherein the first muffler flange defines a plurality of flange communication holes configured to provide the refrigerant in the first inner space in the piston body to the second inner space in the second muffler.

17. The linear compressor according to claim 16, further comprising a muffler filter disposed at an interface at which the first muffler and the second muffler are coupled to each other.

18. The linear compressor according to claim 16, wherein the piston body and the first muffler body are spaced apart from each other to define a discharge space configured to guide refrigerant from the piston to the plurality of flange communication holes, and wherein the first inner space in the piston body comprises the discharge space.

19. The linear compressor according to claim 16, wherein the first muffler body defines a refrigerant passage and extends in an axial direction, and wherein the first muffler flange extends from the first muffler body in a radial direction and is coupled to the piston flange.

20. The linear compressor according to claim 16, wherein the first muffler further comprises a first flange extension part that extends rearward from a flange connection part of the first muffler flange, and wherein the plurality of flange communication holes are arranged along a circumferential direction and disposed between the flange connection part and an outer circumferential surface of the first muffler body.

* * * * *